United States Patent [19]

Buijs

[11] Patent Number: 4,926,591

[45] Date of Patent: May 22, 1990

[54] ROOFING METHOD AND APPARATUS

[75] Inventor: Johannes Buijs, Krimpen a/d IJssel, Netherlands

[73] Assignee: Adviesbureau D3BN Civiel Ingenieurs B.V., Netherlands

[21] Appl. No.: 278,863

[22] Filed: Dec. 2, 1988

[30] Foreign Application Priority Data

Dec. 3, 1987 [NL] Netherlands ..... 8702908

[51] Int. Cl.[5] ..... E04B 1/343

[52] U.S. Cl. ..... 52/63; 52/69; 52/94; 52/122.1; 52/745

[58] Field of Search ..... 52/745, 94, 71, 122.1, 52/69, 741; 135/109, 110

[56] References Cited

U.S. PATENT DOCUMENTS

| | | | |
|---|---|---|---|
| 2,445,368 | 7/1948 | Scharnhorst | 52/63 |
| 3,559,353 | 2/1971 | Partridge | 135/110 |
| 4,467,585 | 8/1984 | Busby | 52/122.1 |
| 4,710,852 | 10/1979 | Danis | 52/71 |

FOREIGN PATENT DOCUMENTS

| | | | |
|---|---|---|---|
| 1101736 | 3/1961 | Fed. Rep. of Germany | 135/109 |
| 2029474 | 3/1980 | United Kingdom | 52/71 |
| 2037838 | 7/1980 | United Kingdom | 52/71 |

*Primary Examiner*—John E. Murtagh

*Attorney, Agent, or Firm*—Roylance, Abrams, Berdo & Goodman

[57] ABSTRACT

A method and an apparatus for roofing a structure or the like by erection of at least one frame and installation of a tent cloth therealong. The frame comprises various elements forming, in the erected position of the frame, roof and wall elements. The roof elements adjoin each other along a ridge line and the wall elements adjoin the roof elements along roof edge lines. The method and apparatus are characterized in that the frame has two frame halves hinged together in a flat starting position and lifted from that position by at least two points. The roof elements are lifted first on the side of the ridge line until the roof elements are at a given angle to each other, in which position there is provided between the roof elements a tie member which, in the loaded condition, defines an angle between the roof elements. After this, the frame is hoisted further, whereby the wall elements swivel outwardly until these have reached a substantially vertical position, in which they are fixed relatively to the roof elements.

21 Claims, 4 Drawing Sheets

ROOFING METHOD AND APPARATUS

This invention relates to a method of roofing a structure or the like by erection of at least one frame and the provision of a tent cloth therealong, said frame including various elements which, in erected position of the frame, form roof and wall elements, said roof elements adjoining each other along a ridge line and said wall elements adjoining each other along roof edge lines.

For roofing, many methods according to the above are known that are usually indicated as the erection of a tent. For roofing works larger than e.g. the performance of local jobs on buried telephone connections, such methods have hardly been employed so far. For activities like roof covering, which should take place under dry conditions, and which have to be frequently interrupted in many regions owing to rain, experiments therewith have been made but always the elaborate erection of the tent impeded large scale application. For roofers, the elaborate erection is particularly disadvantageous, for the tent can often not be left on the roof at night, to prevent storm damage and because they are working on the same site for a relatively short period, so that the tent has to be displaced moreover relatively often. Also for other applications, such as painting and short events, such as markets and festivals, a short assembly and disassembly time may be important.

It is an object of the present invention to provide a method of the above type which can be quickly performed and by means of which a sufficiently large surface area is roofed in one operation. To that effect, the present invention provides a method that is characterized in that the frame consists of two frame halves hinged together in a flat starting position, and lifted from that position by at least two points, with the roof elements being lifted first on the side of the ridge line until the roof elements are at a given angle to each other, in which position a tie member is provided between the roof elements, which tie member, in the loaded condition, defines the angle between the roof elements, after which the frame is hoisted further, whereby the wall elements swivel outwardly until these have reached a substantially vertical position, in which they are fixed relatively to the roof elements.

By means of this method, the roof structure can be assembled quickly with the aid of a hoisting crane, because this always provides for the upward movements for the erection, whereby the roof and wall elements are swivelled to the desired positions, in which they are respectively fixed by means of a tie member and a locking mechanism. The wall elements then swivel to a stable, hanging position, so that no further influencing thereof is necessary and e.g. no poles need be positioned, as is the case with conventional tents. The wall elements only need to be fixed in the above position.

In order that the roof elements may be raised at the ridge line, these are preferably held downward at the roof edge lines until the tie members have been fitted, so that these are loaded at the roof edge lines when the hold-down forces are released. When the points by which the frame is lifted are located in a line extending parallel to, and equidistantly from, the ridge line, on the side of the roof edge line, closely along centres of gravity of the frame halves, little force is required for holding down the roof elements at the roof edge lines and this can be effected by hand.

Before they are lifted, the wall elements are disposed against the underside of the roof elements and preferably have free ends mounting wheels which roll over a base during the swivelling of the wall elements outwardly away from the roof elements, thus preventing damage of said base—e.g. a roof of a building.

In a further elaboration of the present invention, the frame is provided with elements forming wall spreaders in the erected position of the frame, each wall spreader being mounted on one of the wall elements for hinging movement about a line parallel to the ridge line, and extending substantially in one plane, said wall spreaders being swivelled outwardly for use.

The wall portions sloping downwardly from the wall elements reduce the force exerted on the roof by the wind. The spreaders have the additional advantage that a surface area can be roofed that extends beyond a surface area defined by supporting points of the roof, without it being necessary to attach the tent cloth to the base along the outer circumference of the roofed surface area. This advantage is especially important on roofs, since it enables the covering to extend beyond the edge of the roof, where it is not possible to fasten the tent cloth. This possibility is now created by having the wall spreader extend beyond the edge of the roof. When the method according to the present invention is used on a roof of a building, it is thus possible to cover the roof as far as the edge and yet keep it accessible for carrying out operations thereon.

Because the wall spreaders are hingedly mounted and extend substantially in one plane, the flatness of the frame in folded condition is ensured. The space occupied during storage is thus limited.

Mostly, one frame, whose dimensions are limited due to the required transportability, will not be sufficiently large to roof a desired surface area. To overcome this problem, the method of the present invention preferably provides for the possibility of coupling two interspaced frames together with the roof edge lines in alignment with each other, by means of connecting sections which are mounted between corresponding sections parallel to the roof edge lines, of the frames to be coupled, with at least a part of the connecting sections being telescopically extensible from one of the said sections of one of the frames.

This allows a random number of frames to be coupled to each other for obtaining a roof of the desired depth. Due to the telescopic design, the number of loose parts to be transported and to be stored is limited.

For fitting the tent cloth at the gable ends of the structure, in a preferred embodiment of the present invention, the structure is provided at the gable ends of the frame with sections forming gable spreaders in the erected position of the frame, which spreaders have one end hinged to one of the wall elements and a free end provided with an attachment point while, after the installation of the tie member and before the further hoisting of the frame, an element which, in the erected position of the frame, forms a gable element, is hinged to the roof elements at the gable end, and during the further hoisting of the frame to the erected position, is swivelled to a position oriented outwardly and downwardly, the gable element having a free end provided with attachment points and a supporting wheel which, in the said erected position, is further inward than the said attachment points, after which sections are provided between the attachment points on the gable element and the attachment points on the gable spreaders, said sections forming gable sections in the said erected position.

As a result, there is obtained an inclined gable wall capable of roofing an area extending at the gable end beyond supporting points of the structure, without the necessity of attaching the tent cloth to the base alongside the outer circumference of the roofed surface area. This provides the advantages already mentioned, in connection with the inclined walls obtained by wall spreaders, of reducing the force exerted on the structure by the wind and of the base being roofed to a possible edge while yet being accessible for carrying out operations thereon.

Furthermore, the installation of the gable element, before the entire lifting of the roof elements, has the advantage that these elements need not be lifted to a high position but are hoisted together with the roof elements.

The installation of a part of the tent cloth over the frames is effected preferably in such a manner that on opposite wall spreaders of at least one frame and/or connecting sections corresponding with the wall spreaders, there are provided at least one roller on which a part of the tent cloth is wound, and at least one winch. The wall spreaders are fitted with sections hinged to the ridge line in a plane parallel thereto, said sections forming supporting legs in the erected position of the frame and which are provided with projections forming in that position mounting brackets to which the roller and the winch are attached, after which at least one rope is provided over the frame between the portion of the tent cloth and the winch, by means of which the tent cloth is subsequently pulled off the roller and over the frame, said rope being wound on the winch.

The tent cloth can thus be installed and removed very quickly. Because it is moreover sufficient for preventing damage due to storm to remove only the tent cloth, a substantial saving in time can be achieved as compared with the frequent disassembly and assembly of the entire arrangement.

The installation of the roller and the winch on the wall spreaders or corresponding connecting sections enables to obtain the above described walls extending outwardly downwardly beyond an edge, if any, of the base. Due to the supporting legs, there is thus obtained a support for the wall spreaders and possibly for the corresponding connecting sections, so that these do not resiliently yield during the exercise of forces thereon during the rolling on and off of said portion of the tent cloth, thereby impeding the operation. Due to the hinging action of the supporting legs in the plane parallel to the ridge line, it is achieved that the mounting brackets mounted on the supporting legs and adapted to receive the roller or the winch, extend in folded-up condition of the frame, parallel to the plane thereof and, consequently, do not project.

Furthermore, the present invention relates to an apparatus for performing the method according to the present invention, which comprises at least one frame and a tent cloth to be provided therealong, said frame including various elements which, in erected position of the frame, form roof and wall elements, the roof elements adjoining each other alongside a ridge line and the wall elements adjoining the roof elements alongside roof edge lines. The apparatus enabling to perform the method according to the present invention is characterized in that the frame consists of two frame halves adapted to be hinged together, the wall elements being hinged to the roof elements and being lockable relatively thereto, and there being provided at least one tie member, the roof elements and said tie member being arranged so that the tie member, in loaded condition, defines an angle between said roof elements near the roof edge lines between two roof elements adjoining one another along a ridge line.

All hinged main elements are so interconnected that no positioning in an unstable position is necessary. The wall elements, after hoisting, automatically hang vertically downwards and need only be locked, while the angle between the roof elements, after fitting the tie member, is defined by said member. Consequently, the roof can be lifted quickly and with few persons.

Further advantages and particulars according to the present invention will become apparent from the following detailed description of a preferred embodiment of the apparatus according to the present invention, read with reference to the accompanying drawings, in which.

In the drawings, corresponding parts are indicated by the same reference numerals.

Figure 1:
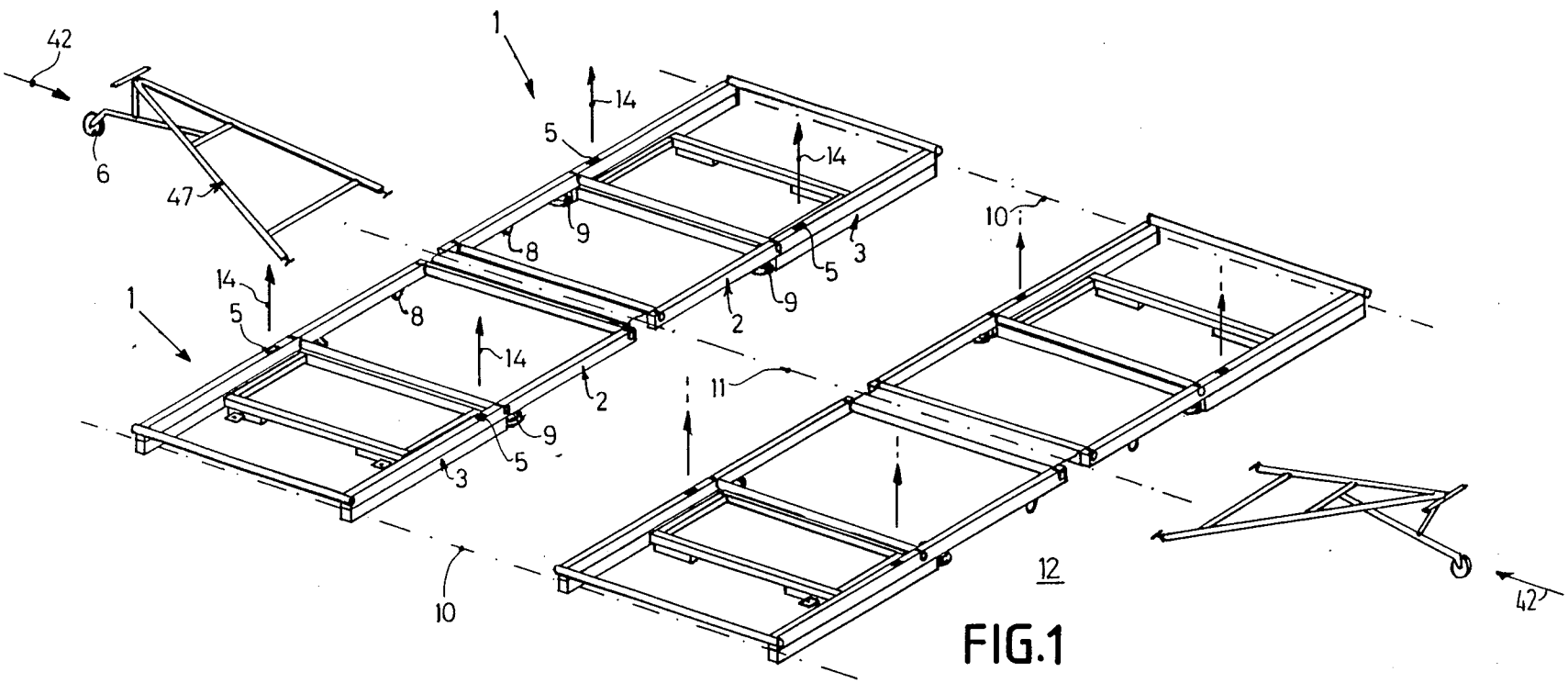
FIG. 1 is a perspective elevational view of an apparatus according to the present invention in a starting position prior to lifting.

FIGS. 1–5 show the erection of a roofing structure in intermediate stages, with the tent cloth not being shown for the sake of clarity. FIG. 1 shows the structure, comprising two frames consisting of frame halves 1, in a planar position, with wall elements 3, as shown, being swivelled preferably against planar roof elements 2, which are hinged along roof edge lines 10 to the roof elements 2. Roof elements 2 are hinged together along a ridge line 11. This attachment is preferably detachable to obtain separately transportable and storable frame portions, which as regards weight and dimensions, permit a better handling than an entire frame.

Gable elements 47 not yet attached to the frames with wheels 6 are shown in lying position at gable ends of the frames indicated by arrows 42. In a later stage of the erection these can be attached at points of attachment 8, preferably in hinged fashion, to roof elements 2. Wheels 9 are mounted on the free ends of the wall elements 3, preferably for swivelling movement. Designated by 12 is a base, e.g. a roof, on which the structure rests. The frames are provided with points of attachment 5 for attaching thereto hoisting ropes indicated by arrows 14.

Figure 2:
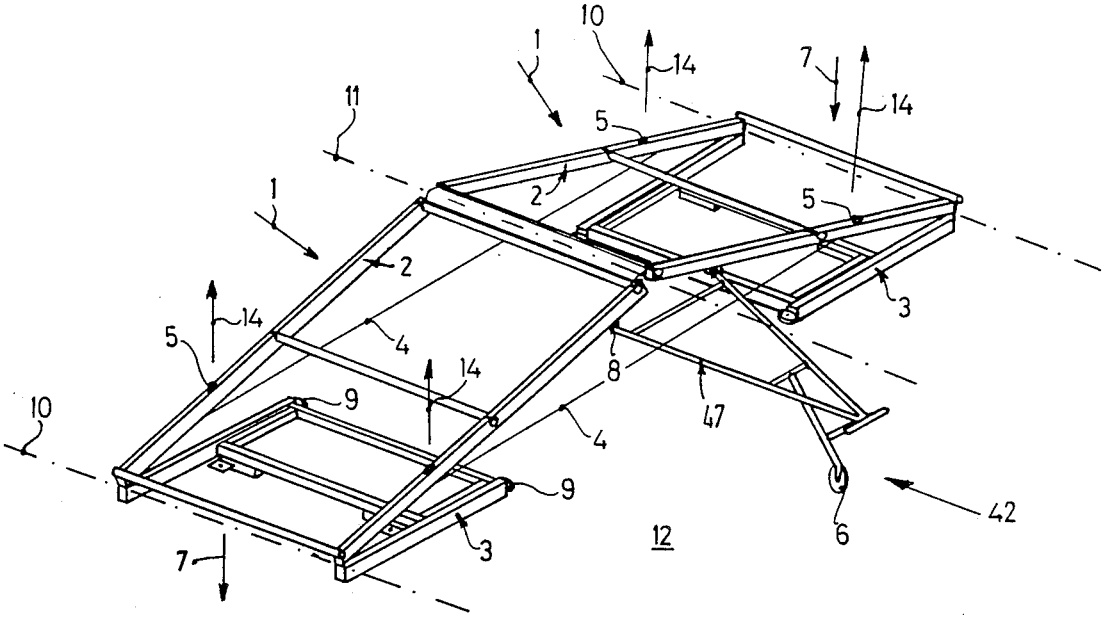
FIG. 2 is an elevational view similar to FIG. 1, showing a part of the apparatus of FIG. 1 in a slightly lifted position.

FIG. 2 shows a part of the structure shown in FIG. 1 in a slightly raised position, there being provided between roof elements 2 near roof edge lines 10, tie members 4, in this instance taking the form of ropes. Points of attachment 5 are preferably disposed at a small distance, in the direction of the roof edge lines, from centres of gravity, not shown, of frame halves 1. Furthermore, during hoisting, wall elements 3 still rest with free ends thereof or wheels 9 on the base 12, so that the entire weight thereof does not yet hang from the roof elements 2. Without additional steps, consequently, the roof elements, during lifting, will be lifted only at the roof edge lines 10. To ensure, however, that the roof elements are hoisted only at the ridge line 11, preferably a downwardly directed force indicated by arrows 7 is exerted on roof elements 2 near roof edge lines 10. By providing points of attachment 5 only a small distance closer to the roof edge lines 10 than the place where the centre of gravity, not shown, of the frame half 1 is located, the required force 7, however, can be kept so small that this can be exerted by hand. When the portions of roof elements 2 near ridge line 11 have been lifted high enough, the tie members 4 can be fitted, which are subsequently subjected to tension, after the exercise of forces 7 has been released, and define an angle between roof elements 2, which also prevents the frame halves from folding together with the ridge line 11 upwards. Front element 47 is attached to points of attachment 8 of the frame. This is effected preferably when the frame is in the position shown in FIG. 2, with the points of attachment 8 at a proper interspace and still within easy reach near the base 12.

Figures 3, 4, 5:
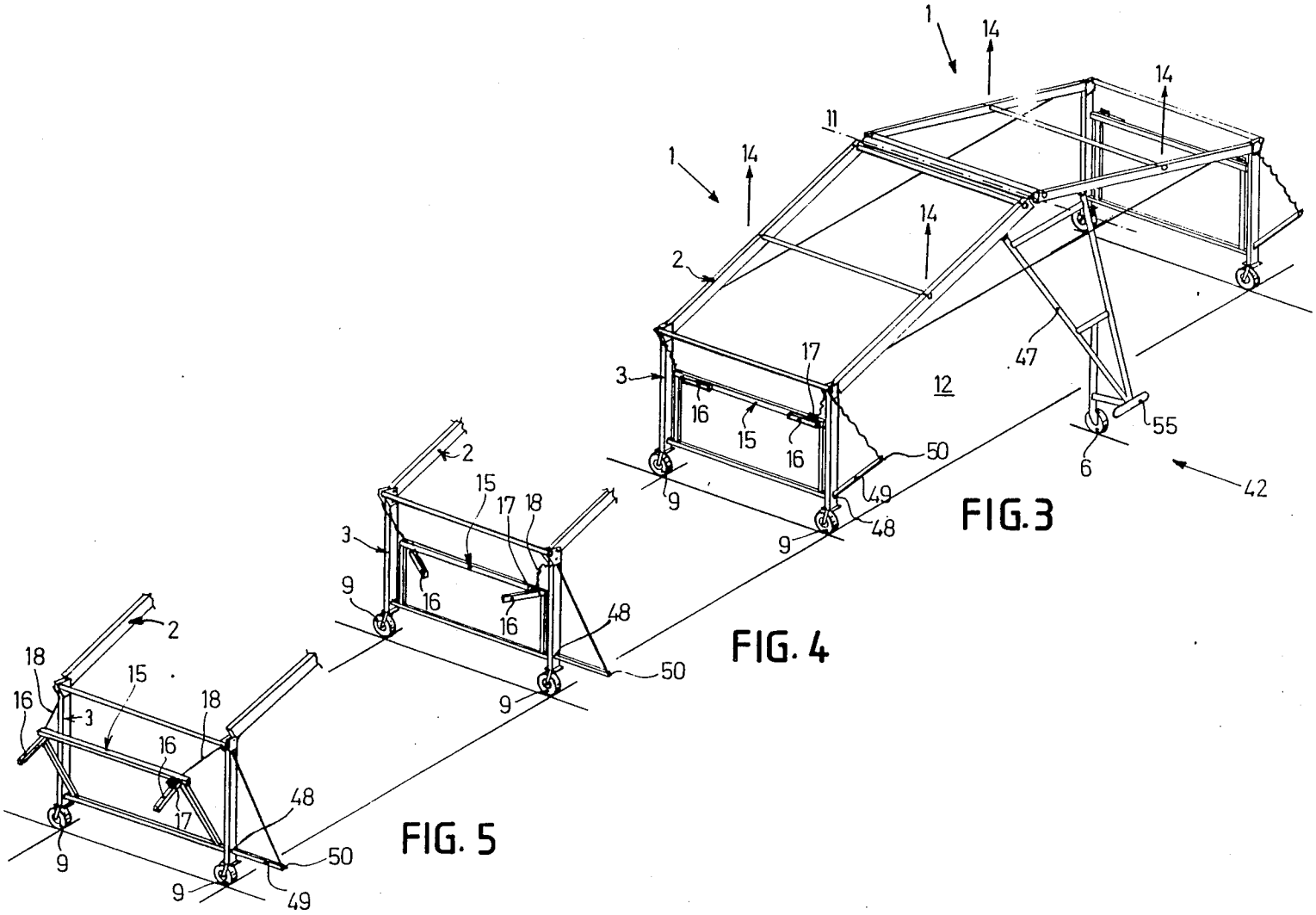
FIG. 3 is an elevational view similar to FIG. 1, and showing the part of the apparatus according to FIG. 2 in a further lifted position.
FIG. 4 is a cut off perspective elevational view of the part of the apparatus shown in FIG. 2.
FIG. 5 is an elevational view similar to FIG. 4 of the part of the apparatus according to FIG. 2 of a slightly folded out wall spreader.

FIGS. 3, 4 and 5 show the frame or at least a part thereof in a position so far raised that wall elements 3 have reached a vertical position, in which they can be locked. The frame is preferably provided with co-planar wall spreaders 15 preferably having legs 16 hinged thereto in a plane parallel to the ridge line 11 and perpendicular to the plane in which extend wall spreaders 15. Preferably, mounting brackets 17 are fitted on at least a portion of legs 16 for mounting a roller 54 (see FIG. 6), whereon is wound a portion 41 (see FIG. 7) of the tent cloth to be fitted among other things over the frame, or a winch 40 (see FIG. 7). Preferably an adjustable pull-up element 18 is provided between wall spreaders 15 and wall element 13. Wheels 6, 9 enable to move the apparatus in erected position, whereby the legs 16 are lifted off the base 12 by lifting wall spreaders 15 off the ground by means of adjustable pull-up elements 18. Wheels 6, 9 also ensure that base 12, during lifting from the position shown in FIG. 2 to that shown in FIG. 3, and during lowering in reverse direction, whereby the end of front element 47 attached to the roof elements is carried along correspondingly as the portion of wall elements 3 attached thereto, is not damaged by ends of the wall and gable elements 3, 47 sliding thereover.

Preferably, gable spreaders 49 are attached foldably to the gable end of the frame by means of hinges 48, for mounting gable sections 51 (see FIG. 6) between mounting stubs 55 and the free ends 50 of the said gable spreaders 49. The wall spreaders, the gable spreaders 15, 49 and the gable elements 47 provide for inclined walls and gables which limit the force exerted by the wind on the assembly as compared with straight walls and gables and make it possible for the roof structure to extend beyond points of support and attachment of the assembly, so that this may extend e.g. beyond roof edges, thereby covering the roof as far as the edge and allowing accessibility for perfoming operations thereon.

Figure 6:
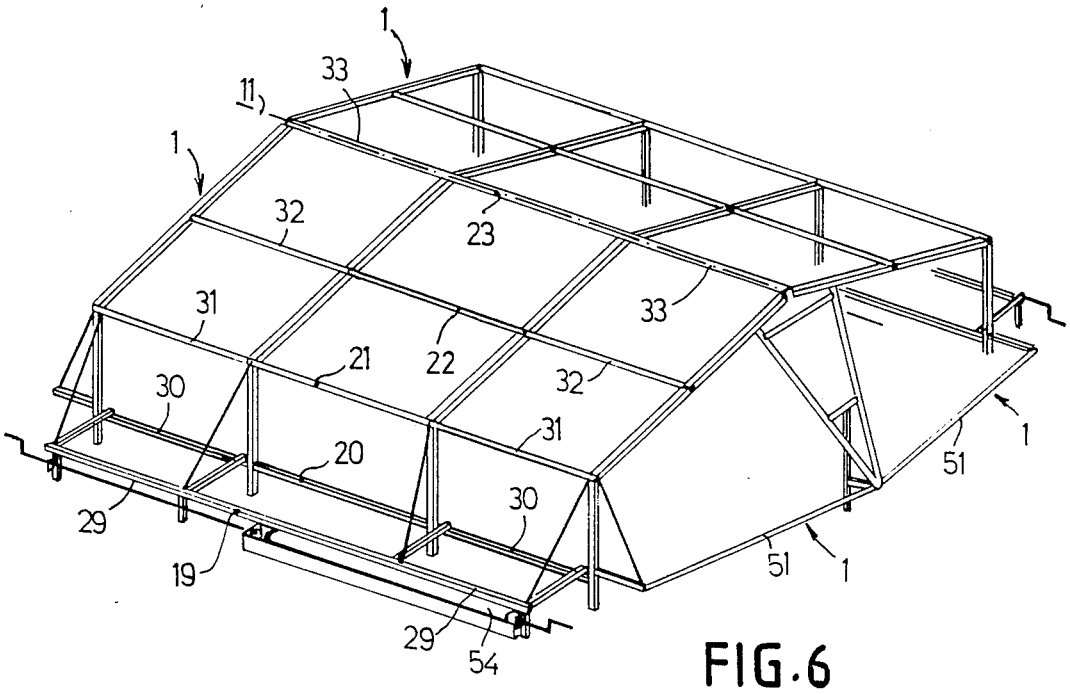
FIG. 6 is a simplified perspective view of the apparatus according to the present invention with erected, interconnected frames.

FIG. 6 shows two interconnected frames, each consisting of frame halves 1, with connecting sections 19, 20, 21, 22 and 23 disposed between them. The connecting sections are each disposed so as to be co-extensive with corresponding sections 29, 30, 31, 32 and 33 parallel to the ridge line 11. Connecting sections 19, 20, 21, 22 and 23 increase the roofed surface area in a simple manner.

The connecting sections 20, 21, 22 and 23 preferably telescope longitudinally into and out of the corresponding sections 30, 31, 32 and 33, parallel to ridge line 11, of either of two adjoining frames, so that the number of parts to be transported and stored separately is limited. Likewise, the assembly and disassembly time of the apparatus is limited by this telescopic design, since connecting sections 20, 21, 22 and 23 need not be supplied and discharged separately.

Figure 7:
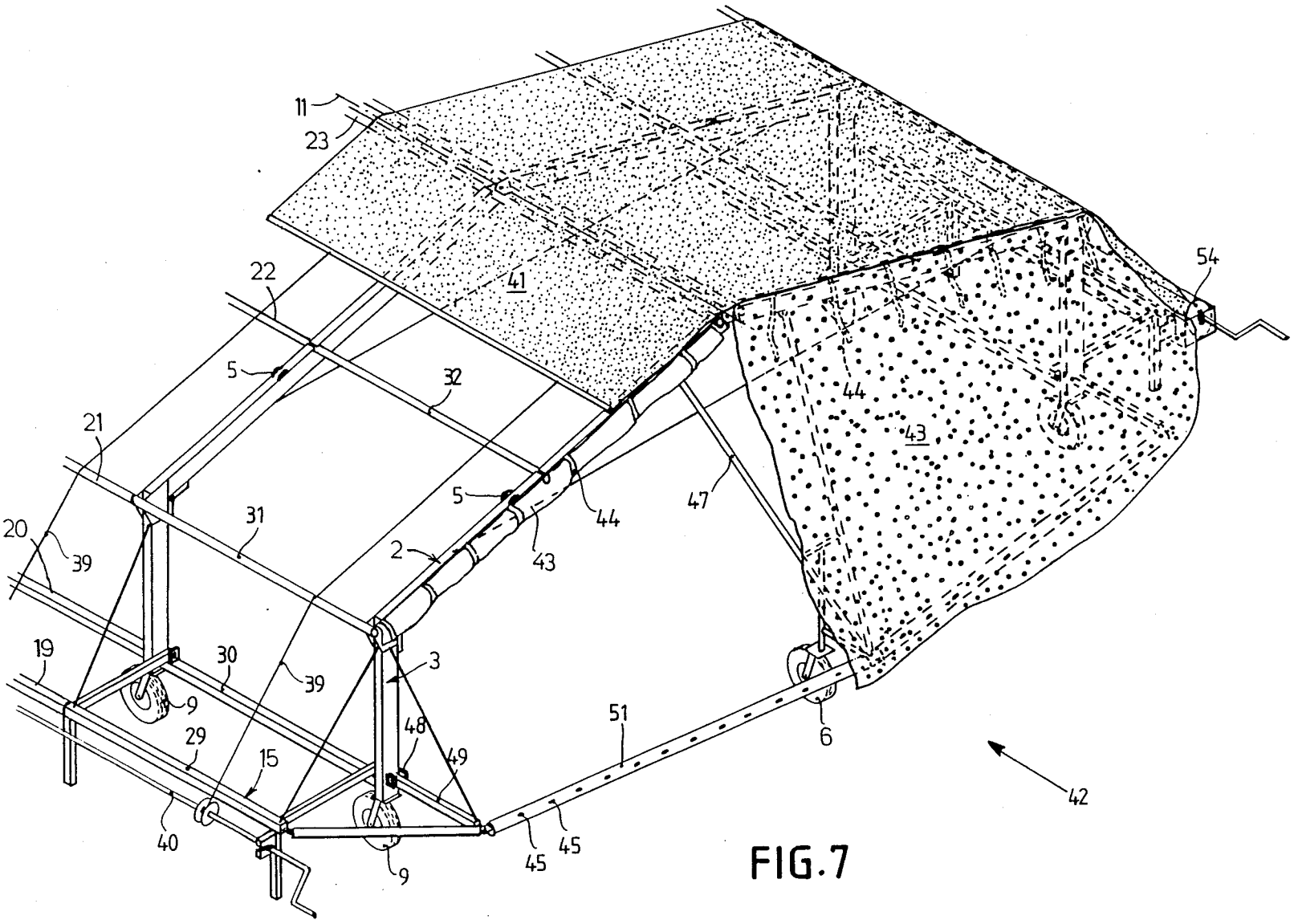
FIG. 7 is an elevational view similar to FIG. 1 of the apparatus according to the present invention with erected frames and a partly installed tent cloth.

FIG. 7 shows how a part of the gable end of the first frame is closed by means of a first part 43 of the gable portion of the tent cloth provided on roof elements 2 for the purpose, said cloth being lowered to that effect, while a second part 43 is still connected against roof element 2 through loops 44, which have been loosened for the lowering of the first part 43. For fastening the underside of the gable portion 43 of the tent cloth to the gable section 51, there are provided push button portions 45 on the gable sections and at the gable end of the wall spreaders, said push button portions 45 corresponding with push button portions, not shown, provided on the gable portion of the tent cloth.

By means of ropes 39 and a winch 40, a portion 41 of the tent cloth has been pulled off roller 54 partly over the first frame and a part of the connecting sections 19, 20, 21, 22 and 23, thus providing a tent cloth that can be installed and removed very quickly. This is particularly favourable, because to prevent damage owing to storm it is mostly sufficient to remove tent cloth 41, 43, while the frames and the other parts can remain in erected position.

The tent cloth may consist of any suitable cloth, foil or combination thereof, which combinations include both cloth-foil laminates and combinations with inserted pieces of foil, e.g. in the form of transparent windows from synthetic plastics material.

It should further be noted that connecting sections 19, 20, 21, 22 and 23 and the sections 29, 30, 31, 32 and 33 parallel to ridge line 11, as viewed in cross section, have an outer circumference having a substantially arcuate portion situated exteriorly of the frame. As a result, the wear on ropes 39 and tent cloth 41 is limited during the unwinding of tent cloth 41 over the frame and the rewinding thereof, and, moreover, the concomitant friction is limited, so that the operation is simplified.

What I claim is:

1. A method of forming a roofed structure from a frame and a tent cloth, comprising the steps of:

lifting the frame having two roof elements pivotally joined along a ridge line defining two frame halves and having two wall elements pivotally joined to the roof elements along roof edge lines from a flat starting position by at least two points, such that the roof elements are lifted first on a side of the ridge line until the roof elements are at a given angle relative to each other;

connecting a tie member to the roof elements, in a loaded condition, to define the given angle between the roof elements;

additionally lifting the frame and swivelling the wall elements outwardly to substantially vertical positions in which the wall elements are relatively fixed to the roof elements; and swivelling outwardly wall spreaders, hinged to the wall elements about lines parallel to the ridge line, to positions in which the wall spreaders extend substantially in one plane.

2. A method according to claim 1 wherein supporting legs, hinged to the wall spreaders, are pivoted to an erect position in a plane parallel to the ridge line;

a rope is provided over the frame and is attached at one end to a winch on one wall spreader at another end to a tent cloth wound on a roller mounted on an opposite wall spreader; and the rope is wound on the winch, pulling the tent cloth off the roller and over the frame.

3. A method according to claim 1 wherein the frame is lifted at points on a line extending parallel to and equidistant from said ridge line, on sides of the roof edge lines and closely along centers of gravity of the frame halves.

4. A method according to claim 1 wherein wheels on free ends of the wall element roll over a base when the wall elements are swivelled outwardly.

5. A method according to claim 1 wherein at least two interspaced frames with co-extensive roof edge lines are coupled to each other by connecting sections mounted between corresponding sections extending parallel to the roof edge lines of the frames to be coupled, at least a part of the connecting sections being telescopically slidable out of one of the frames.

6. A method according to claim 1 further comprises swivelling gable spreaders, hinged at first ends thereof to the wall elements and having attachment points at free ends thereof, away from the wall elements;

after connection of the tie member, but before the additional lifting of the frame, hingedly coupling a gable element at a gable end of the roof elements;

during the additional lifting of the frame, swivelling the gable element to an erect position oriented outwardly and downwardly, the gable element having a supporting wheel and attachment points at a free end thereof, in the erect position the supporting wheel being located inwardly of the attachment points; and attaching gable sections to the attachment points of the gable element and the gable spreaders.

7. A method of forming a roofed structure from a frame and a tent cloth, comprising the steps of:

lifting the frame having two roof elements pivotally joined along a ridge line defining two frame halves and having two wall elements pivotally joined to the roof elements along roof edge lines from a flat starting position by at least two points, such that the roof elements are lifted first on a side of the ridge line until the roof elements are at a given angle relative to each other;

connecting a tie member to the roof elements, in a loaded condition, to define the given angle between the roof elements;

additionally lifting the frame and swivelling the wall elements outwardly to substantially vertical positions in which the wall elements are relatively fixed to the roof elements;

swivelling gable spreaders, hinged at first ends thereof to the wall elements and having attachment points at free ends thereof, away from the wall elements;

after connection of the tie member, but before the additional lifting of the frame, hingedly coupling a gable element at a gable end of the roof elements;

during the additional lifting of the frame, swivelling the gable element to an erect position oriented outwardly and downwardly, the gable element having a supporting wheel and attachment points at a free end thereof, in the erect position the supporting wheel being located inwardly of the attachment points; and attaching gable sections to the attachment points of the gable element and the gable spreaders.

8. A method according to claim 7 wherein the supporting legs, hinged to the wall spreaders, are pivoted to an erect position in a plane parallel to the ridge line;

a rope is provided over the frame and is attached at one end to a winch on one wall spreader and at another end to a tent cloth wound on a roller mounted on an opposite wall spreader; and the rope is wound on the winch, pulling the tent cloth off the roller and over the frame.

9. A method according to claim 7 wherein the frame is lifted at points on a line extending parallel to and equidistant from said ridge line, on sides of the roof edge lines and closely along centers of gravity of the frame halves.

10. A method according to claim 7 wherein wheels on free ends of the wall elements roll over a base when the wall elements are swivelled outwardly.

11. A method according to claim 7 wherein at least two interspaced frames with co-extensive roof edge lines are coupled to each other by connecting sections mounted between corresponding sections extending parallel to the roof edge lines of the frames to be coupled, at least a part of the connecting sections being telescopically slidable out of one of the frames.

12. An apparatus for forming a roofed structure from a frame and a tent cloth, comprising:

a frame including two roof elements hingedly joined along a ridge line and two wall elements hingedly joined to said roof elements along roof edge lines, said ridge line dividing said frame into two frame halves;

first means for locking said wall elements to said roof elements;

a tie member, coupled to said roof elements, for locking said roof elements in a predetermined position in a loaded condition defining an angle between said roof element;

a wall spreader hingedly coupled to each of said wall elements for pivotal movement about an axis parallel to said ridge line, each said wall spreader being substantially rectangular and extending substantially in one plane, each said wall spreader having tent cloth supporting points; and a tent cloth extending over said frame when erected and extending outwardly and downwardly from said roof edge lines to said tent cloth supporting points.

13. An apparatus according to claim 12 wherein each said wall spreader comprises a free end connected by at least one pull-up member of adjustable length to a point on the respective wall element adjacent the respective roof edge line.

14. An apparatus according to claim 12 wherein each said wall spreader comprises supporting legs and mounting brackets, said mounting brackets on one of said wall spreaders supporting a roller about which at least part of said tent cloth is wound, said mounting brackets on the other of said wall spreaders supporting a winch; and a rope is attached at one end thereof to said tent cloth and at an opposite end thereof to said winch, and extends over the frame between said tent cloth and said winch.

15. An apparatus according to claim 14 wherein said frame comprises sections extending parallel to said ridge line and having transverse cross sections with rounded outer circumferences for engaging said tent cloth.

16. An apparatus according to claim 12 wherein each of said frames halves comprises one attachment element for lifting said frame, each said attachment element being equally spaced from said ridge line close to a center of gravity of the respective frame half.

17. An apparatus according to claim 12 wherein at least two adjoining frames are interconnected in spaced relationship, with co-extensive roof lines, by connecting sections mounted between corresponding sections of the adjoining frames, said corresponding sections being parallel to the roof edge lines, at least a part of the connecting sections having a smaller cross section than the said corresponding sections and being slidable into the said corresponding sections of one of the frames.

18. An apparatus according to claim 12 where said frame comprises:

at least one gable element with means for hingedly attaching said gable element to a gable end of said frame on said roof elements and with a free end having attachment elements and a supporting wheel;

front spreaders hingedly coupled to gable ends of said wall elements and having free ends with attachment elements; and gable sections mounted between and coupled to said attachment elements of said gable element and said gable spreaders.

19. An apparatus for forming a roofed structure from a frame and a tent cloth, comprising:

a frame including two roof elements hingedly joined along a ridge line and two wall elements hingedly joined to said roof elements along roof edge lines, said ridge line dividing said frame into two frame halves;

first means for locking said wall elements to said roof elements;

a tie member, coupled to said roof elements, for locking said roof elements in a predetermined position in a loaded condition defining an angle between said roof elements;

at least one gable element with means for hingedly attaching said gable element to a gable end of said frame on said roof elements and with a free end having attachment elements and a supporting wheel;

front spreaders hingedly coupled to gable ends of said wall elements and having free ends with attachment elements; and gable sections mounted between and coupled to said attachment elements of said gable element and said gable spreaders.

20. An apparatus according to claim 19 wherein each of said frame halves comprises one attachment element for lifting said frame, each said attachment element being equally spaced from said ridge line close to a center of gravity of the respective frame half.

21. An apparatus according to claim 19 wherein at least two adjoining frames are interconnected in spaced relationship, with co-extensive roof lines, by connecting sections mounted between corresponding sections of the adjoining frames, said corresponding sections being parallel to the roof edge lines, at least a part of the connecting sections having a smaller cross section than the said corresponding sections and being slidable into the said corresponding sections of one of the frames.

* * * * *